US005364247A

United States Patent [19]

Fukanuma et al.

[11] Patent Number: 5,364,247

[45] Date of Patent: Nov. 15, 1994

[54] SEALING STRUCTURE FOR SCROLL TYPE COMPRESSOR

[75] Inventors: Tetsuhiko Fukanuma; Hisao Kobayashi; Tetsuo Yoshida; Yoshitami Kondo, all of Kariya, Japan

[73] Assignee: Kabushiki Kaisha Toyoda Jidoshokki Seisakusho, Kariya, Japan

[21] Appl. No.: 63,438

[22] Filed: May 18, 1993

[30] Foreign Application Priority Data

May 21, 1992 [JP] Japan ..... 4-129111

[51] Int. Cl.[5] ..... F04C 18/04; F04C 27/00

[52] U.S. Cl. ..... 418/55.2; 418/55.4; 418/142

[58] Field of Search ..... 418/55.2, 55.4, 142; 277/204

[56] References Cited

U.S. PATENT DOCUMENTS 5,217,358 6/1993 Mori et al. ..... 418/55.2

FOREIGN PATENT DOCUMENTS 0105684 4/1984 European Pat. Off. .
57-148088 9/1982 Japan .
59-58187 4/1984 Japan .
60-128995 8/1985 Japan .
62-276289 12/1987 Japan ..... 418/55.2

OTHER PUBLICATIONS

Abstract of Japanese Patent Publication No. 62-223488, published Oct. 1, 1987.

*Primary Examiner*—John J. Vrablik
*Attorney, Agent, or Firm*—Brooks Haidt Haffner & Delahunty

[57] ABSTRACT

A scroll type compressor includes a fixed scroll having a fixed spiral element and a fixed end plate, and an orbiting scroll is revolvable without rotating itself in opposition to the fixed scroll. The orbiting scroll includes an orbiting spiral element and an orbiting end plate. A plurality of compression chambers, of which volumes are decreased in response to the revolution of the orbiting scroll, are defined between the scrolls. A discharge port opens to the discharge chambers. The thicknesses of initiating sections of the fixed and orbiting spiral elements are designed larger than those of remaining sections thereof. Sealing members having a spiral shape are slidably interposed between the fixed and orbiting end plates of the fixed and orbiting scrolls, and the initiating sections of the fixed and orbiting spiral elements are in opposition to the respective end plates. The cross sectional area of an initiating section of the sealing member, which is integrally movable with at least the orbiting scroll, is larger than that of remaining section thereof. The sealing member is capable of covering a part of the discharge port.

11 Claims, 5 Drawing Sheets

SEALING STRUCTURE FOR SCROLL TYPE COMPRESSOR

FIELD OF THE INVENTION

The present invention relates to a scroll type compressor provided with a fixed scroll and an orbiting scroll, which compresses a gas, as the volume of a compression chamber defined between both scrolls decreases. More particularly, it relates to a sealing structure.

DESCRIPTION OF THE RELATED ART

In a conventional scroll type compressor, a compression chamber converges to a gap defined between initiating sections of spiral elements of the orbiting and fixed scrolls according to the movement of the orbiting scroll. A refrigerant gas in the compression chamber is discharged through a discharge port which is bored in a base plate of the fixed scroll. Generally larger compression reaction forces are applied on the initiating sections of the spiral elements than on remaining sections thereof, during the compression operation. Therefore, the initiating sections of the spiral elements must have a higher pressure withstanding ability than those of the remaining sections thereof.

Japanese Unexamined Patent Publication No. 59-58187 discloses a scroll type compressor. This compressor has initiating sections of spiral elements having generally larger thicknesses than those of the remaining sections thereof. Generally, to produce spiral elements of both scrolls, involute curves are utilized to form both outer and inner spiral walls from initiating points to terminating points thereof, respectively. However, in this conventional compressor, a part of the inner spiral wall of the initiating section of the spiral element includes a straight portion. As the straight portion is formed, the thickness of the initiating section of the spiral element is enlarged compared to that of a compressor employing involute curves. The enlargement of the thickness increases the pressure withstanding ability of the initiating sections of the spiral elements.

To optimize the operational efficiency of the compressor, high sealing ability and low discharge resistance are demanded, in addition to the improvement of the pressure withstanding ability. For example, Japanese Unexamined Patent Publication No. 57-148088 and Japanese Unexamined Utility Model Publication No. 60-128995 disclose structures which increase the sealing ability of the slidable contacting portions between the base plates of the scrolls and the end surfaces of the spiral elements thereof. Each one of the compressors disclosed in the above-mentioned publications includes sealing members interposed between the respective base plates and the end surfaces of the spiral elements.

The discharge resistance influences the discharge pulsation and the operational efficiency of the compressor. When discharge pulsation occurs, noise is generated. To reduce the discharge resistance, the compressor disclosed in Japanese Unexamined Patent Publication No. 57-148088 includes notched grooves communicating to a discharge port, which are formed in the initiating section of the spiral element of the fixed scroll, in order to increase the radius of the discharge port.

To regulate the re-expansion of the compressed refrigerant gas, which was once compressed in the compression chamber, in a successive compression chamber under a discharge process, the discharge port should not overlap with the successive compression chamber, when the discharge process is completed. Therefore, the radius of the discharge port will be restricted. When the enlarged initiating section of the spiral element described in Japanese Unexamined Patent Publication No. 59-58187 is employed, however, the radius of the discharge port can be increased. This can be achieved by enlarging the area of the initiating section of the spiral element of the orbiting scroll which covers the discharge port.

However, by simply increasing the radius of the discharge port, the disposed locations of the sealing members will be influenced. The initiating section of the sealing member greatly influences the prevention of leakage of the high pressured gas in the compression chamber which communicates to the discharge port. Therefore, the initiating section of the sealing member is desirably placed as close as possible to the initiating section of the spiral element. When the radius of the discharge port is simply increased, the sealing member integrally movable with the orbiting scroll will be extended over the discharge port to overlap therewith. This overlapping may cause the initiating section of the sealing member to be damaged due to the discharged high pressure gas from the discharge port. Therefore, the initiating section of the sealing member at the orbiting scroll cannot be extended to the vicinity of the initiating section of the fixed spiral element beyond the relative position of the discharge port.

SUMMARY OF THE INVENTION

The primary object of the present invention is to provide a sealing structure for a scroll type compressor, which achieves high pressure withstanding ability, high sealing performance and low discharge resistance of the initiating section of the spiral element.

To achieve the foregoing object, the scroll type compressor according to the present invention includes a fixed scroll having a fixed spiral element and a fixed end plate. An orbiting scroll includes an orbiting spiral element and an orbiting end plate, and is revolvable in opposition to oppose to the fixed scroll. A plurality of compression chambers are defined between the fixed and orbiting scrolls, and volumes thereof are decreased in response to the revolution of the orbiting scroll. A discharge port opens to one of the compression chambers. The thicknesses of the initiating sections of the fixed and orbiting spiral elements are larger than those of remaining sections thereof, respectively. Spiral sealing members are interposed between the fixed and orbiting end plates and the associated orbiting and fixed spiral elements, and are in slidable contact with the orbiting and fixed end plates, respectively. At least one of the sealing members is movable with the orbiting spiral element, and a cross-section area of an initiating section of the sealing member is larger than that of the remaining section thereof.

Therefore, the pressure withstanding ability of the initiating section of the spiral element is increased. Further, the area of the initiating section of the spiral element for covering the discharge port can be increased, and the width of the initiating section of the sealing member can be widened, Therefore, the strength of the initiating section of the sealing member can be improved. When the radius of the discharge port is to be increased, damage thereto can be prevented, even though the sealing member extends over the discharge port. As a result, the initiating position of the sealing member can be as close as possible to the initiating section of the spiral element of the orbiting scroll. Furthermore, the discharge resistance can be reduced due to increasing the radius of the discharge port.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings, in which:

DETAILED DESCRIPTION OF THE PREFERRED EMBODIMENT

A preferred embodiment according to the present invention will now be described referring to FIGS. 1 through 4.

Figure 1:
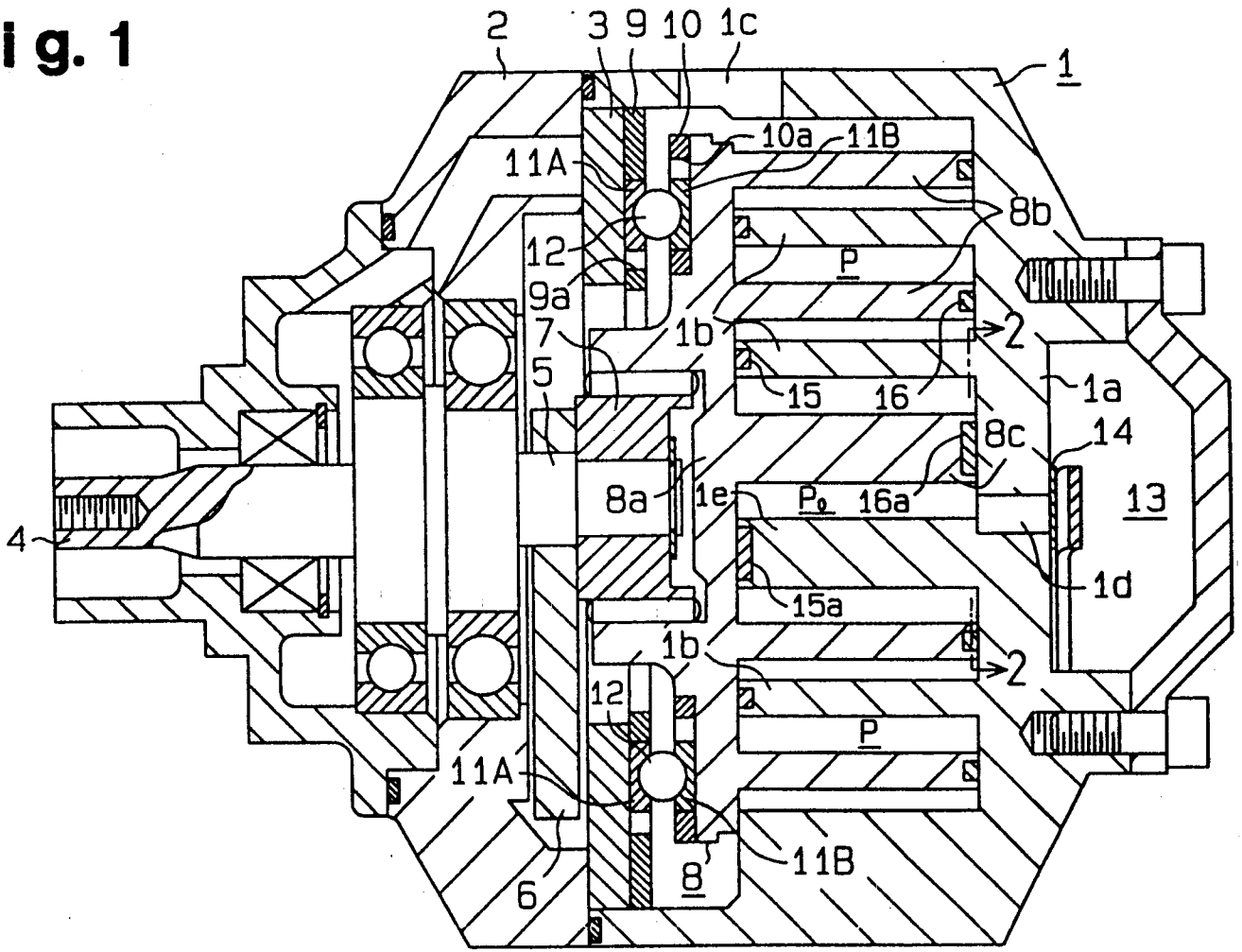
FIG. 1 is a cross sectional view showing an embodiment of a compressor according to the present invention.

As shown in FIG. 1, a front housing 2 is secured to a fixed scroll 1 which has a combined function as a rear housing. A ring-shaped base plate 3 is secured at the inner peripheral surface of the fixed scroll 1, which contacts with the end surface of the front housing 2.

A rotary shaft 4 is rotatably supported within the front housing 2. An eccentric pin 5 is integrally formed with the rotary shaft 4. The eccentric pin 5 protrudes into the peripheral wall of the fixed scroll 1 through a central bore formed at the base plate 3.

A balance weight 6 and a bushing 7 are rotatably supported by the eccentric pin 5. A revolvable orbiting scroll 8 is supported by the bushing 7 so as to oppose and slidably engage with the fixed scroll 1. Compression chambers P and P0 are defined between fixed and orbiting end plates 1*a* and 8*a*, and fixed and orbiting spiral elements 1*b* and 8*b* of both scrolls 1 and 8, respectively.

A fixed ring 9 is fixed to the inner surface of the base plate so as to oppose orbiting scroll 8. A plurality of regulating holes 9*a* each having a circular shape are equiangularly formed in the fixed ring 9 so as to regulate the revolution of the orbiting scroll 8. An orbiting ring 10 is fixed to a back surface of the orbiting end plate 8*a*. A plurality of regulating holes 10*a* each having a circular shape are equiangularly formed in the orbiting ring 10. Disc shaped shoes 11A and 11B each having a smaller radius than those of the regulating holes 9*a* and 10*a* are fitted into the regulating holes 9*a* and 10*a*, respectively. A ball 12 is inserted into the space defined between the opposing shoes 11A and 11B.

Both shoes 11A and 11B, and the ball 12 are clamped between the base plate 3 and the orbiting scroll 8 due to the reaction in the compression stage where the gas is compressed by both scrolls. Apparently, they become an integral part. A circular revolvable area of the shoes 11A and 11B is defined within the regulating holes 9*a* and 10*a*. The diameter of the revolvable area of the shoes 11A and 11B is designed to be equal to the orbiting radius of the eccentric pin 5. Therefore, the orbiting scroll 8 will revolve without rotating itself, while shoes 11A and 11B are nipped between the respective circumferences of the regulating holes 9*a* and 10*a* and move along the circumferences of the regulating holes 9*a* and 10*a* in response to the revolution of the eccentric pin 5.

Refrigerant gas guided through an inlet 1*c* formed in the outer peripheral wall of the fixed scroll 1 flows into the compression chambers P defined between both scrolls 1 and 8. Volumes of the compression chambers are decreased in response to the revolution of the oribiting scroll 8, so as to converge to the gap defined between initiating sections 1*e* and 8*c* of the fixed and orbiting spiral elements 1*b* and 8*b* of the scrolls 1 and 8, respectively. The gas compressed according to the decrease of the volumes of the compression chambers P and P0 is discharged into a discharge chamber 13 through a discharge port 1*d* formed in the fixed end plate 1*a*. The discharge chamber 13 is normally closed by means of a discharge valve 14 disposed at the discharge chamber 13 side.

Sealing members 15 and 16 formed of synthetic resin are fitted into the distal surfaces of the fixed and orbiting spiral elements 1*b* and 8*b*, respectively. The sealing member 15 contacts the orbiting end plate 8*a* of the orbiting scroll 8. The seal member 16 contacts the fixed end plate 1*a* of the fixed scroll 1. Both sealing members 15 and 16 are in slidable contact with the orbiting and fixed end plates 8*a* and 1*a*, respectively, in response to the orbiting movement of the orbiting scroll 8.

Figure 2:
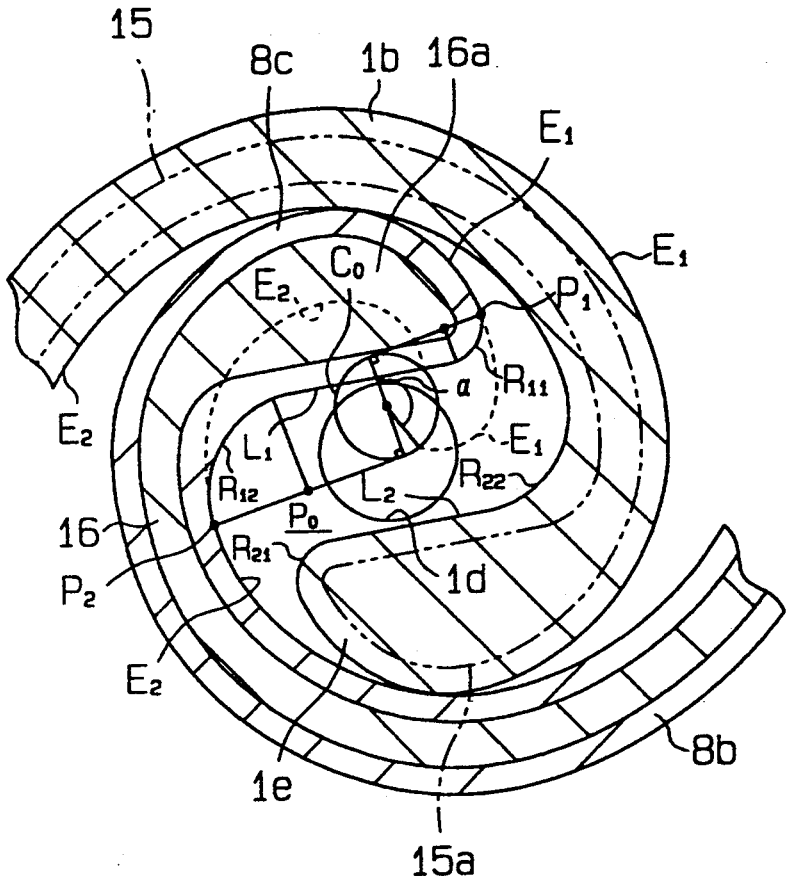
FIG. 2 is an enlarged fragmentary cross sectional view taken along line 2—2 in FIG. 1.

As shown in FIG. 2, the initiating sections 1*e* and 8*c* of the fixed and orbiting spiral elements 1*b* and 8*b* are formed thicker than any other remaining portions thereof, so as to increase the pressure withstanding ability. An inner wall of the initiating section 8*c* is formed along a first circular arc R12, a second circular arc R11 and a straight line L1. An inner wall of the initiating section 1*c* is formed along a first circular arc R22, a second circular arc R21 and a straight line L2. The circular arcs R11 and R21 have the same radius and length. The circular arcs R12 and R22 have the same radius and length. The straight line L1 is a common tangent line to the circular arcs R11 and R12. The straight line L2 is a common tangent line to the circular arcs R21 and R22.

Major portions of the inner and outer walls of the fixed and orbiting spiral elements 1*b* and 8*b* except the initiating sections 1*e* and 8*c* are formed along involute curves E1 and E2. The involute curves E1 and E2 originate from a basic circle C0. The second circular arcs R11 and R21 are smoothly connected to the involute curves E1. The first circular arcs R12 and R22 are smoothly connected to the involute curves E2. A connecting point P1 connecting the circular arc R11 or R21 with the involute curve E1 corresponds to the distal point of the involute line having an arbitrary involute angle $\alpha$.

A connecting point P2 connecting the circular arc R12 or R22 with the involute curve E2 corresponds to the distal point of the involute line having an involute angle $(\alpha+180°)$ which is advanced from the involute angle $\alpha$ by 180°. The walls along the straight lines L1 and L2 will slidably contact each other at the predetermined orbital points with respect to the orbiting scroll 8, according to the shape of the walls, as shown in FIG. 3.

Initiating sections 15*a* and 16*a* of the spiral sealing members 15 and 16 extend closely to the initiating sections of the fixed and orbiting spiral elements 1*b* and 8*b*, respectively. The initiating sections 15*a* and 16*a* are broader than the remaining sections thereof, so as to match the shapes of the initiating sections 1*e* and 8*c* of the fixed and orbiting spiral elements 1*b* and 8*b*, respectively.

Figure 3:
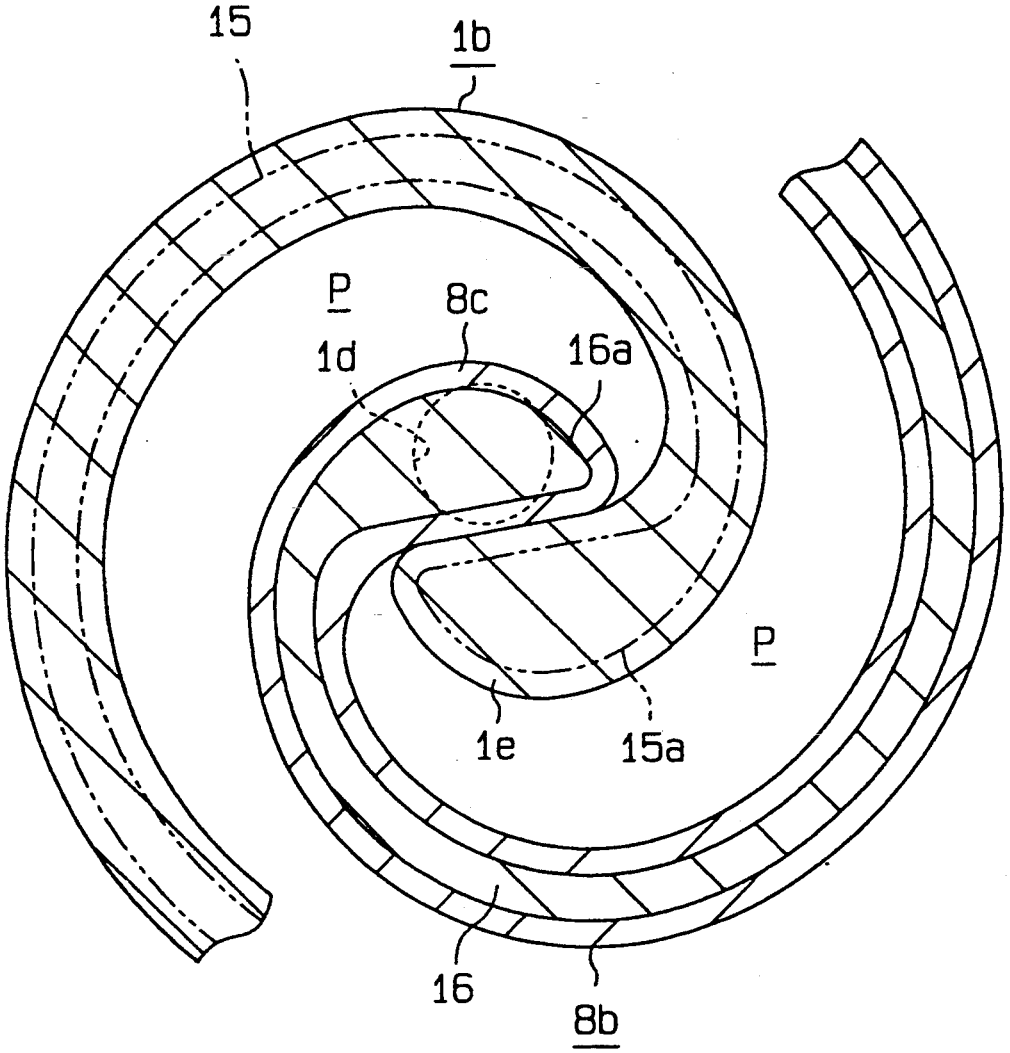
FIG. 3 is an enlarged cross sectional view showing the essential portion of the compressor when the discharge process is completed.

As shown in FIG. 3, when both walls slidably contacts with each other along the straight lines L1 and L2. In other words, when the discharging of the refrigerant gas from the compression chamber P0 to the discharge port 1*d* is completed, the initiating section 16*a* of the sealing member 16 is capable of covering a major part of the discharge port 1*d*.

Figure 4:
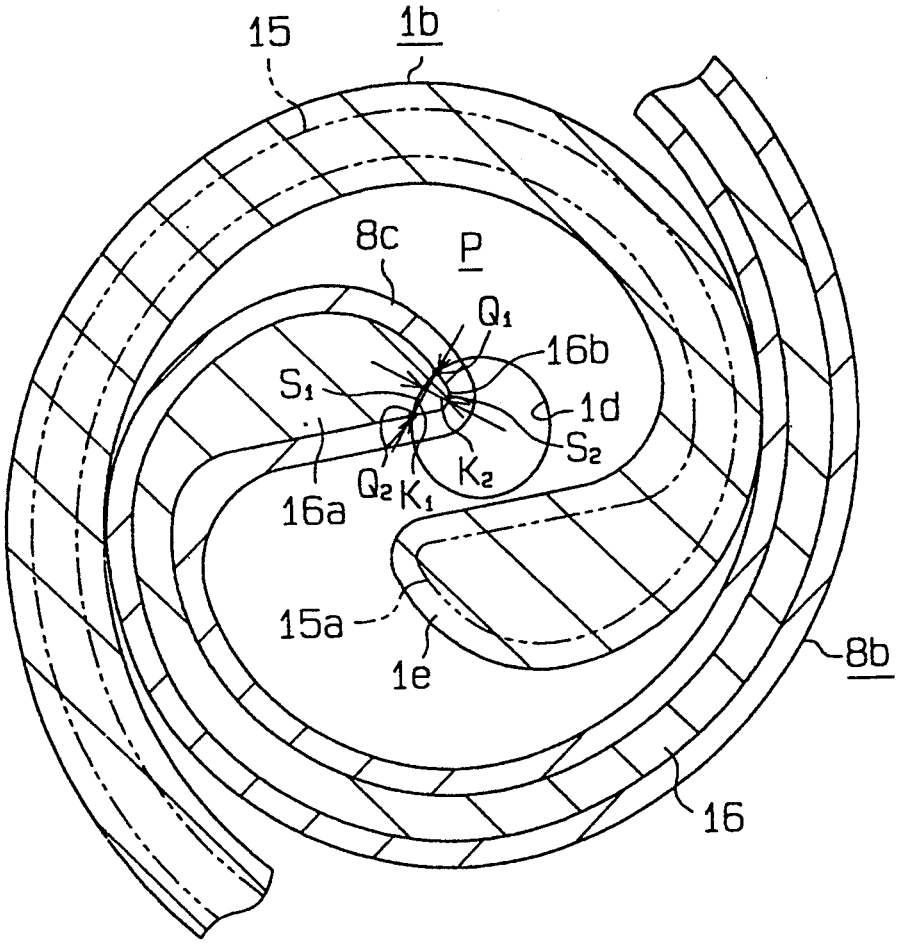
FIG. 4 is an enlarged cross sectional view showing the essential portion of the compressor when the initiating section of the sealing member disposed at the orbiting scroll side is protected over the discharge port.

When the orbiting scroll 8 further revolves around from the point described in FIG. 3, a projection 16*b* of the initiating section 16*a* comes over the discharge port 1*d* as shown in FIG. 4. At this time, the pressure in the compression chamber P0 is maximized. The projection end 16*b* is subjected to the suction force toward the discharge port 1*d* as the highly pressurized refrigerant gas gushes out from the discharge port 1*d*.

However, the width of the initiating section 16*a* of the sealing member 16 is conformed with the thickness of the initiating section 8*c* of the orbiting spiral element 8*b*. Accordingly, the durability of the initiating section 16*a* is significantly greater than those of the remaining sections of the sealing member 16. Therefore, the projection end 16*b* of the sealing member 16 extending over the discharge port 1*d* will not be damaged even when the highly pressurized refrigerant gas is applied thereon. The tip of the initiating section of the sealing member 16 can be placed as closely as possible to the initiating section of the orbiting spiral element 8*b*, so as to improve the sealing ability of the compression chamber P0.

According to this embodiment, the walls are formed along the straight line L2 in such a way that the thickness of the initiating section 8*c* increases in comparison with the case where the walls are formed along the internal involute curves E2. Therefore, the area where the initiating section 8*c* of the orbiting scroll 8 covers the discharge port 1*d* can be significantly increased. As a result, the cross sectional area of the discharge port 1*d* can be enlarged, and the discharge resistance can be reduced.

As the radius of the discharge port 1*d* is enlarged, the proportion of the projection end 16*b* of the sealing member 16 extending over the discharge port 1*d* is increased. As a suitable indication for exhibiting the proportion of the extended portion, for example, it can be expressed by taking a ratio of K2/K1, where K1 is a length of the straight line between intersecting points Q1 and Q2 of the circumferential edge of the discharge port 1*d* with the circumferential edge of the sealing member 16, and K2 is a magnitude which the sealing member 16 extends over the discharge port 1*d*. It can also be expressed by taking a ratio of S1/S2, where S1 is an arc length between the intersecting points Q1 and Q2 along the circumference of the discharge port 1*d*, and S2 is an arc length between the intersecting points Q1 and Q2 along the circumferential edge of the sealing member 16. By appropriately selecting either the ratio K2/K1 or the ratio S1/S2, the damage to the initiating sections 16*a* may be avoided, and the radius of the discharge port 1*d* can be enlarged. The preferred ratio of K2/K1 or S1/S2 is approximately 2/3.

As described above, the present invention includes that the thickness of the initiating section of the spiral element is larger than that of the remaining section thereof, and at .least the cross sectional area of the initiating section of the sealing member which is integrally movable with the orbiting scroll is larger than that of the remaining area thereof. Therefore, the high pressure withstanding ability, high sealing ability and low discharge resistance of the initiating section of the spiral element can be achieved.

Although only one embodiment of the present invention has been described heretofore, it should be apparent to those skilled in the art that the present invention may be embodied in many other specific forms without departing from the spirit or scope of the invention. Particularly, it should be understood that the following alterations of the structure can be embodied in the present invention.

Figure 5:
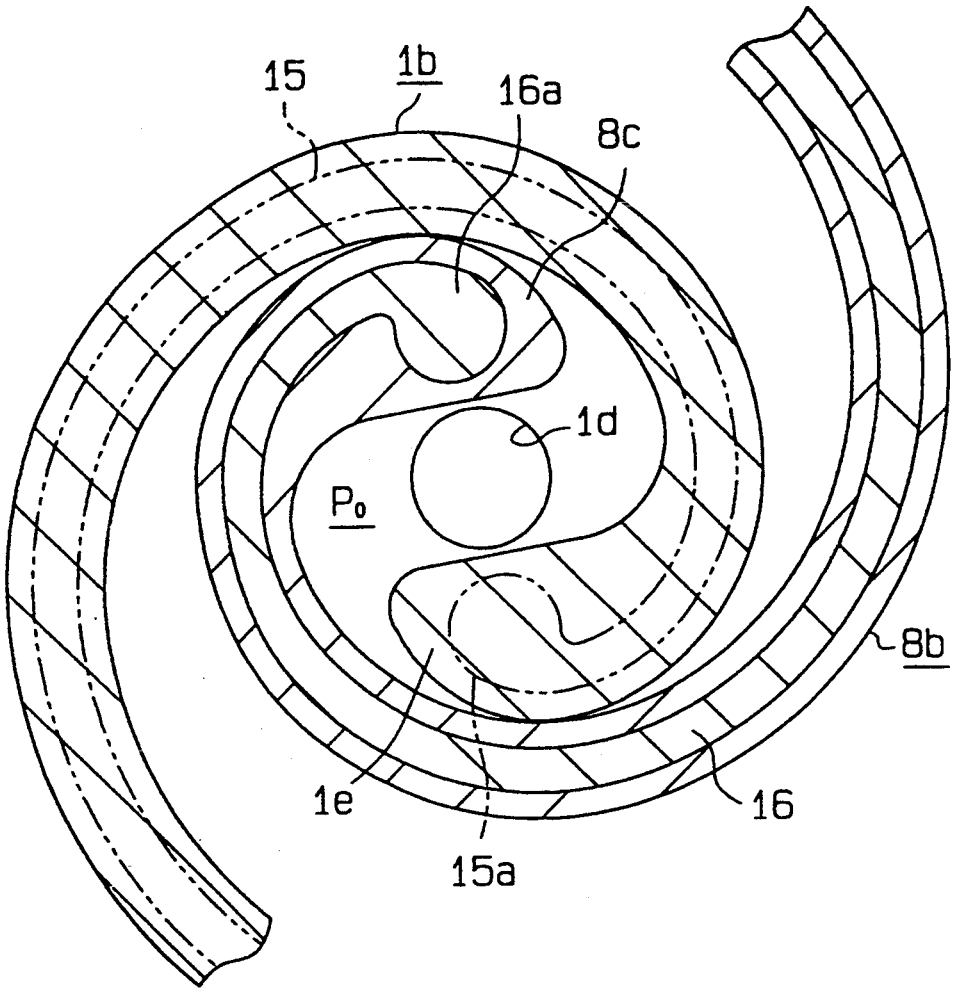
FIG. 5 is an enlarged cross sectional view showing the essential portion of a compressor according to another embodiment.

(1) As shown in FIG. 5, the shapes of the initiating sections 15*a* and 16*a* of the sealing members 15 and 16, respectively can be altered to either a circular or an elliptical shape.

(2) For increasing the strength of the initiating section of the sealing member, the thickness of the initiating section can be altered to be larger than those of the remaining sections thereof.

(3) The cross sectional area of only the initiating section of the sealing member for the orbiting scroll is altered to be larger than those of the remaining section thereof.

(4) The initiating section of the spiral element is not to be limited to being formed along a circular arc or a straight line. If suitable for forming the compression chambers, other curves can be employed.

What is claimed is:

1. A sealing structure for a scroll type compressor comprising:

a fixed scroll having a fixed spiral element and a fixed end plate;

an orbiting scroll having an orbiting spiral element and an orbiting end plate, and being revolvable in opposition to the fixed scroll;

a plurality of compression chambers defined between the fixed and orbiting scrolls, the volumes thereof being decreased in response to said revolving of the orbiting scroll;

a discharge port through and centrally located with respect to said fixed end plate, each said compression chamber opening to said discharge port periodically during said revolving of said orbiting scroll;

said fixed and orbiting spiral elements each having an initiating section adjacent to said discharge port, each said initiating section having a thickness which is greater than the thicknesses of remaining sections thereof, respectively, said initiating section of the orbiting spiral element periodically closing said discharge port during said revolving of the orbiting scroll;

each said fixed and orbiting spiral elements having respective spiral sealing members thereon and respectively interposed in sliding contact with said fixed and orbiting end plates; and at least said sealing member on said orbiting spiral element having an initiating section adjacent to said initiating section of said orbiting spiral element and movable with the orbiting spiral element, said sealing member initiating section having a cross-sectional area which is lager than the cross-sectional area of remaining sections thereof, said initiating section of the sealing member covering a part of the area of said discharge port when said initiating section of the orbiting spiral element periodically closes said discharge port.

2. The sealing structure for a scroll type compressor according to claim 1, wherein the initiating section of the sealing member of said orbiting spiral element periodically covers a major part of the discharge port during said revolving of said orbiting scroll.

3. The sealing structure for a scroll type compressor according to claim 1, wherein the sealing members are formed of synthetic resin.

4. The sealing structure for a scroll type compressor according to claim 1, wherein said initiating sections of the fixed and orbiting spiral elements have respective straight line portions which are in slidable contact with each other while the compressor is in a compression stage.

5. The sealing structure for a scroll type compressor according to claim 4, wherein major portions of the fixed and orbiting spiral elements except the initiating sections thereof are formed along involute curves, and connecting sections between the major portions and the initiating sections are formed along first circular arcs, respectively.

6. The sealing structure for a scroll type compressor according to claim 5, wherein projection ends of the initiating sections of the fixed and orbiting spiral elements are formed along second circular arcs, respectively.

7. The sealing structure for a scroll type compressor according to claim 6, wherein radiuses of the second circular arcs are smaller than those of the first circular arcs, respectively.

8. A sealing structure for a scroll type compressor comprising:

a fixed scroll having a fixed spiral element and a fixed end plate;

an orbiting scroll having an orbiting spiral element and an orbiting end plate, and being revolvable in opposition to the fixed scroll;

a plurality of compression chambers defined between the fixed and orbiting scrolls, the volumes thereof being decreased in response to said revolving of the orbiting scroll;

a discharge port through and centrally located with respect to said fixed end plate, each said compression chamber opening to said discharge port periodically during said revolving of said orbiting scroll;

said fixed and said orbiting spiral elements each having an initiating section adjacent to said discharge port, each said initating section having a thickness which is greater than the thicknesses of remaining sections thereof, respectively;

said initiating section of the orbiting spiral element closing said discharge port periodically during said revolving of said orbiting scroll;

said initiating sections of the fixed and orbiting spiral elements having respective straight line portions which are in slidable contact with each other while the compressor is in a compression stage;

major portions of the respective of said fixed and orbiting spiral elements except said initiating sections thereof being formed along involute curves, and connecting sections between the major portions and the initiating sections being formed along first circular arcs, respectively;

projection ends of the initiating sections of the fixed and orbiting spiral elements being formed along second circular arcs;

each said fixed and orbiting spiral elements having respective spiral sealing members thereon and respectively interposed in sliding contact with said fixed and orbiting end plates; and at least said sealing member on said orbiting element having an initiating section adjacent to said initiating section of said orbiting spiral element and movable with the orbiting spiral element, said sealing member initiating section having cross-sectional area which is larger than the cross-sectional area of remaining sections thereof, said initiating section of the sealing member covering at least a part of the area of said discharge port when said initiating section of the orbiting spiral element periodically closes said discharge port.

9. The sealing structure for a scroll type compressor according to claim 8, wherein the initiating section of the sealing member of said orbiting spiral element periodically covers a major part of the discharge port during said revolving of said orbiting scroll.

10. The sealing structure for a scroll type compressor according to claim 8, wherein the sealing members are formed of synthetic resin.

11. The sealing structure for a scroll type compressor according of claim 8, wherein radiuses of the second circular arcs are smaller than those of the first circular arcs, respectively.

* * * * *

UNITED STATES PATENT AND TRADEMARK OFFICE

CERTIFICATE OF CORRECTION

PATENT NO. : 5,364,247
DATED : November 15, 1994
INVENTOR(S) : T. Fukanuma et al It is certified that error appears in the above-indentified patent and that said Letters Patent is hereby corrected as shown below:

In the Abstract, line 3, after "scroll" delete "is"; line 11, delete "designed"; line 19, "section" should read --sections--.

Column 2, line 56, "cross-section" should read --cross-sectional--; line 58, "section" should read --sections--.

Column 3, line 55, after "plate" insert --3--.

Column 4, line 17, correct spelling "orbiting"; line 44, "1c" should read --1e--.

Column 5, line 14, "contacts" should read --contact--.

Column 6, line 26, after "respectively" insert comma --,--; line 34, "section" should read --sections--; line 36 delete "to"; line 37, delete "be".

UNITED STATES PATENT AND TRADEMARK OFFICE

CERTIFICATE OF CORRECTION

PATENT NO. : 5,364,247

DATED : November 15, 1994

INVENTOR(S) : T. Fukanuma et al

It is certified that error appears in the above-indentified patent and that said Letters Patent is hereby corrected as shown below:

Column 7, line 6 "lager" should read --larger--.

Column 8, line 35, after "having" insert --a--; line 51, change "of" (first occurrence) to --to--.

Signed and Sealed this

Second Day of May, 1995

Bruce Lehman

*Attest:*

BRUCE LEHMAN

*Attesting Officer*

*Commissioner of Patents and Trademarks*